US008109514B2

(12) United States Patent
Toyama

(10) Patent No.: US 8,109,514 B2
(45) Date of Patent: Feb. 7, 2012

(54) CARD SHUFFLING DEVICE AND METHOD

(75) Inventor: Hirohide Toyama, Darien, IL (US)

(73) Assignee: Shuffle Tech International LLC, Chicago, IL (US)

( * ) Notice: Subject to any disclaimer, the term of this patent is extended or adjusted under 35 U.S.C. 154(b) by 0 days.

(21) Appl. No.: 12/828,954

(22) Filed: Jul. 1, 2010

(65) Prior Publication Data

US 2010/0264582 A1 Oct. 21, 2010

Related U.S. Application Data

(63) Continuation of application No. 12/121,484, filed on May 15, 2008, now Pat. No. 7,854,430.

(60) Provisional application No. 60/931,646, filed on May 24, 2007.

(51) Int. Cl.
*A63F 1/12* (2006.01)

(52) U.S. Cl. ..... 273/149 R

(58) Field of Classification Search ..... 273/149 R, 273/149 P

See application file for complete search history.

(56) References Cited

U.S. PATENT DOCUMENTS

| | | | |
|---|---|---|---|
| 1,955,926 | A | 4/1934 | Matthaey |
| 2,001,220 | A | 5/1935 | Smith |
| 2,159,958 | A | 5/1939 | Sachs |
| 2,430,681 | A | 11/1947 | Johnson |
| 2,706,117 | A | 4/1955 | Notz |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,753,185 | A | 7/1956 | Johnson |
| 2,755,090 | A | 7/1956 | Aldrich |
| 2,815,214 | A | 12/1957 | Hall |
| 3,067,885 | A | 12/1962 | Kohler |
| 3,147,978 | A | 9/1964 | Sjöstrand |
| 3,305,237 | A | 2/1967 | Granius |

(Continued)

FOREIGN PATENT DOCUMENTS

JP 2001327647 A 11/2001

OTHER PUBLICATIONS

John N. Hansen Co., "Four Deck Automatic Card Shuffler," AreYouGame.com, obtained at the Internet address: http://www.areyougame.com/Interact/search.asp?qmethod=0&q=jhb232, 1 page.

(Continued)

*Primary Examiner* — Benjamin Layno

(74) *Attorney, Agent, or Firm* — Brinks Hofer Gilson & Lione

(57) ABSTRACT

A device for shuffling a deck of playing cards is described. The cards are placed in a compartment having a shape of a rectangular parallelepiped, and dimensioned so that the cards are constrained in rotation in two of the three axes. The device is oriented so that a thickness dimension of the deck is horizontal, and groups of cards of the deck of cards are ejected in a vertical direction so as to provide a spacing of between a top edge of cards at rest and a bottom edge of the cards being ejected. The time duration of the ejection process is sufficient to effectively randomize the deck of cards. The ejection of cards may be by a plurality of pistons, and the pistons may be actuated by a motor, a solenoid or by air pressure.

18 Claims, 7 Drawing Sheets

U.S. PATENT DOCUMENTS

| | | | |
|---|---|---|---|
| 3,588,116 | A | 6/1971 | Miura |
| 3,589,730 | A | 6/1971 | Slay |
| D224,658 | S | 8/1972 | Cole et al. |
| 3,975,010 | A | 8/1976 | Schisselbauer et al. |
| 4,310,160 | A | 1/1982 | Willette et al. |
| 4,497,488 | A | 2/1985 | Plevyak et al. |
| 4,513,969 | A | 4/1985 | Samsel, Jr. |
| 4,515,367 | A | 5/1985 | Howard |
| 4,586,712 | A | 5/1986 | Lorber et al. |
| 4,770,421 | A | 9/1988 | Hoffman |
| 4,807,884 | A | 2/1989 | Breeding |
| 4,832,342 | A | 5/1989 | Plevyak et al. |
| 4,951,950 | A | 8/1990 | Normand et al. |
| 4,969,648 | A | 11/1990 | Hollinger et al. |
| 5,000,453 | A | 3/1991 | Stevens et al. |
| 5,096,197 | A | 3/1992 | Embury |
| 5,261,667 | A | 11/1993 | Breeding |
| 5,344,146 | A | 9/1994 | Lee |
| 5,356,145 | A | 10/1994 | Verschoor |
| 5,382,024 | A | 1/1995 | Blaha |
| 5,397,133 | A | 3/1995 | Penzias |
| 5,431,399 | A | 7/1995 | Kelley |
| 5,445,377 | A | 8/1995 | Steinbach |
| 5,575,475 | A | 11/1996 | Steinbach |
| 5,584,483 | A | 12/1996 | Sines et al. |
| 5,676,372 | A | 10/1997 | Sines et al. |
| 5,692,748 | A | 12/1997 | Frisco et al. |
| 5,695,189 | A | 12/1997 | Breeding et al. |
| 5,718,427 | A | 2/1998 | Cranford et al. |
| 5,944,310 | A | 8/1999 | Johnson et al. |
| 5,989,122 | A | 11/1999 | Roblejo |
| 6,019,368 | A | 2/2000 | Sines et al. |
| 6,068,258 | A | 5/2000 | Breeding et al. |
| D432,588 | S | 10/2000 | Tedham |
| 6,139,014 | A | 10/2000 | Breeding et al. |
| 6,149,154 | A | 11/2000 | Grauzer et al. |
| 6,250,632 | B1 | 6/2001 | Albrecht |
| 6,254,096 | B1 | 7/2001 | Grauzer et al. |
| 6,299,167 | B1 | 10/2001 | Sines et al. |
| 6,325,373 | B1 | 12/2001 | Breeding et al. |
| 6,568,678 | B2 | 5/2003 | Breeding et al. |
| 6,588,750 | B1 | 7/2003 | Grauzer et al. |
| 6,588,751 | B1 | 7/2003 | Grauzer et al. |
| 6,651,981 | B2 | 11/2003 | Grauzer et al. |
| 6,651,982 | B2 | 11/2003 | Grauzer et al. |
| 6,655,684 | B2 | 12/2003 | Grauzer et al. |
| 6,659,460 | B2 | 12/2003 | Blaha et al. |
| 6,676,127 | B2 | 1/2004 | Johnson et al. |
| 6,698,756 | B1 | 3/2004 | Baker et al. |
| D488,193 | S | 4/2004 | Girard |
| D490,481 | S | 5/2004 | Hessing |
| 6,886,829 | B2 | 5/2005 | Hessing et al. |
| 6,889,979 | B2 | 5/2005 | Blaha et al. |
| 6,959,925 | B1 | 11/2005 | Baker et al. |
| 7,300,056 | B2 | 11/2007 | Gioia et al. |
| 2004/0224777 | A1 | 11/2004 | Smith et al. |
| 2005/0206077 | A1 | 9/2005 | Grauzer et al. |

OTHER PUBLICATIONS

Home Casino Games, Online Gamblers Gift Shop, "Card Shufflers," obtained at the Internet address: http://www.homecasinogames.com/Catalog/ItemList.cfm?CategoryId=874, 2 pages.

Opamerica, Excalibur Electronics WSOP Pro Shuffle (425-WSOP), obtained at the Internet address: http://www.opamerica.com/product_info.php/products_id/869, 1 page.

International Search Report from PCT international application No. PCT/US2008/064628 dated Oct. 28, 2008, (3 pages).

Written Opinion of the International Searching Authority for International Application No. PCT/US2008/064628, dated Oct. 28, 2008, (5 pages).

Feb. 16, 2010 Non-Final Office Action, U.S. Appl. No. 12/121,484 (14 pages).

Response to Feb. 16, 2010 Non-Final Office Action, U.S. Appl. No. 12/121,484, filed in the PTO on Mar. 19, 2010 (11 pages).

John N. Hansen Co., "Four Deck Automatic Card Shuffler," AreYouGame.com, obtained at the Internet address: http://www.areyougame.com/Interact/search.asp?qmethod=0&q=jhb232, 1 page.

Home Casino Games, Online Gamblers Gift Shop, "Card Shufflers," obtained at the Internet address: http://www.homecasinogames.com/Catalog/ItemList.cfm?CategoryId=874, 2 pages.

Opamerica, Excalibur Electronics WSOP Pro Shuffle (425-WSOP), obtained at the Internet address: http://www.opamerica.com/product_info.php/products_id/869, 1 page.

International Search Report from PCT international application No. PCT/US2008/064628 dated Oct. 28, 2008, (3 pages).

Written Opinion of the International Searching Authority for International Application No. PCT/US2008/064628, dated Oct. 28, 2008, (5 pages).

Feb. 16, 2010 Non-Final Office Action, U.S. Appl. No. 12/121,484 (14 pages).

Response to Feb. 16, 2010 Non-Final Office Action, U.S. Appl. No. 12/121,484, filed in the PTO on Mar. 19, 2010 (11 pages).

Side cross-section

CARD SHUFFLING DEVICE AND METHOD

This application is a continuation of U.S. application Ser. No. 12/121,484, filed on May 15, 2008 now U.S. Pat. No. 7,854,430, which claims priority to U.S. provisional application 60/931,646, filed on May 24, 2007, each of said applications being which is incorporated herein by reference.

TECHNICAL FIELD

This application relates to an apparatus and method for preparing playing cards for use in a game of cards.

BACKGROUND

Various games are played using playing cards, where a typical game uses one or more decks, which may have 52 cards of various values and suits. Examples of such games that are popular in the United States are poker, blackjack, bridge, and canasta. In other countries, different games of cards are similarly popular, and may use decks of cards having more or less than 52 cards, and having different markings. Players of games of cards have an interest in ensuring that the playing cards are dispensed for the game in a random manner, giving no one player an unfair advantage. Preparing a deck of cards for play of the game may be accomplished either manually or automatically. In the case of manual preparation, the cards may be cut, riffled and stripped. The process is performed multiple times. It is believed that performing a cut-riffle process approximately 7 times will result in a sufficiently random distribution of cards within a deck. However this is time consuming and it is common to perform the process only 3-4 times.

SUMMARY

A device for shuffling cards is described, including a compartment sized and dimensioned to receive a plurality of cards, each card of the plurality of cards having a height dimension and a width dimension parallel to a face thereof, a thickness dimension orthogonal to the face thereof; and, edges around the periphery thereof. A forcer facing an edge of a card of the plurality of cards exerts an intermittent force on a group of cards of the plurality of cards.

In an aspect, a device for shuffling a deck of cards includes, a compartment having the shape of a rectangular parallelepiped, sized and dimensioned to receive a deck of cards, and having first and second dimensions larger than a first dimension of a face of a card of the deck of cards, and a thickness of the deck of cards, respectively. A forcer applies an impulsive force to a group of cards of the deck of cards so as to eject the group of cards of the deck of cards into a third dimension, the third dimension being greater than the twice a second dimension of the face of the card.

A method of shuffling cards is disclosed, the method including the steps of providing a container having interior dimensions of a rectangular parallelepiped; inserting a deck of cards into the container; orienting the container so that a plane coincident with a face of a card, and an edge of the card, are parallel to a gravity vector; and propelling groups of cards of the deck of cards in a direction parallel to the face of the cards.

DETAILED DESCRIPTION

Exemplary embodiments may be better understood with reference to the drawings, but these embodiments are not intended to be of a limiting nature. Like numbered elements in the same or different drawings perform equivalent functions.

When a specific feature, structure, or characteristic is described in connection with an example, it will be understood that one skilled in the art may effect such feature, structure, or characteristic in connection with other examples, whether or not explicitly stated herein. Embodiments of this invention may be implemented in hardware, firmware, software, or any combination thereof, and may include instructions stored on a machine-readable medium.

The act of randomizing a deck of cards prior to use in a game of cards is intended to make the order of the cards in the deck of cards unknown to a person playing the game of cards, even with the state of the deck of cards being known prior to the randomization. This is considered to place all of the players of the game in a state of equal knowledge of the situation which obtains at any stage of the play of the game. In common parlance, this process is called "shuffling the deck," and may include the steps of cutting, striping and riffling as described, for example, in U.S. patent application Ser. No. 11/706,707, filed on Feb. 15, 2007, which is incorporated herein by reference.

Herein, the term "shuffling" the deck is used to describe an apparatus and method which distributes the cards of a deck of cards so as to achieve an effectively random distribution of the order of the cards. The details of the operation of the shuffling device and method may not correspond to the traditional steps of cutting, stripping or riffling; however, the result may be that the deck of cards has been placed in an effectively random order state. An "effectively random" ordered deck of cards would be understood by a person of skill in the art to, for example, defeat a strategy of card counting as a betting strategy in a card game. Such a shuffle would be accepted by players of the game as to be fair to all of the participants, so that the game may be played according to an accepted strategy where each card distributed is not known a priori. Of course, in games of cards where the cards are exposed during the play of the game, a player may use knowledge of the exposed cards, and cards held by the player, to deduce the remaining cards in the deck, but not the explicit order of the cards.

Figure 1:
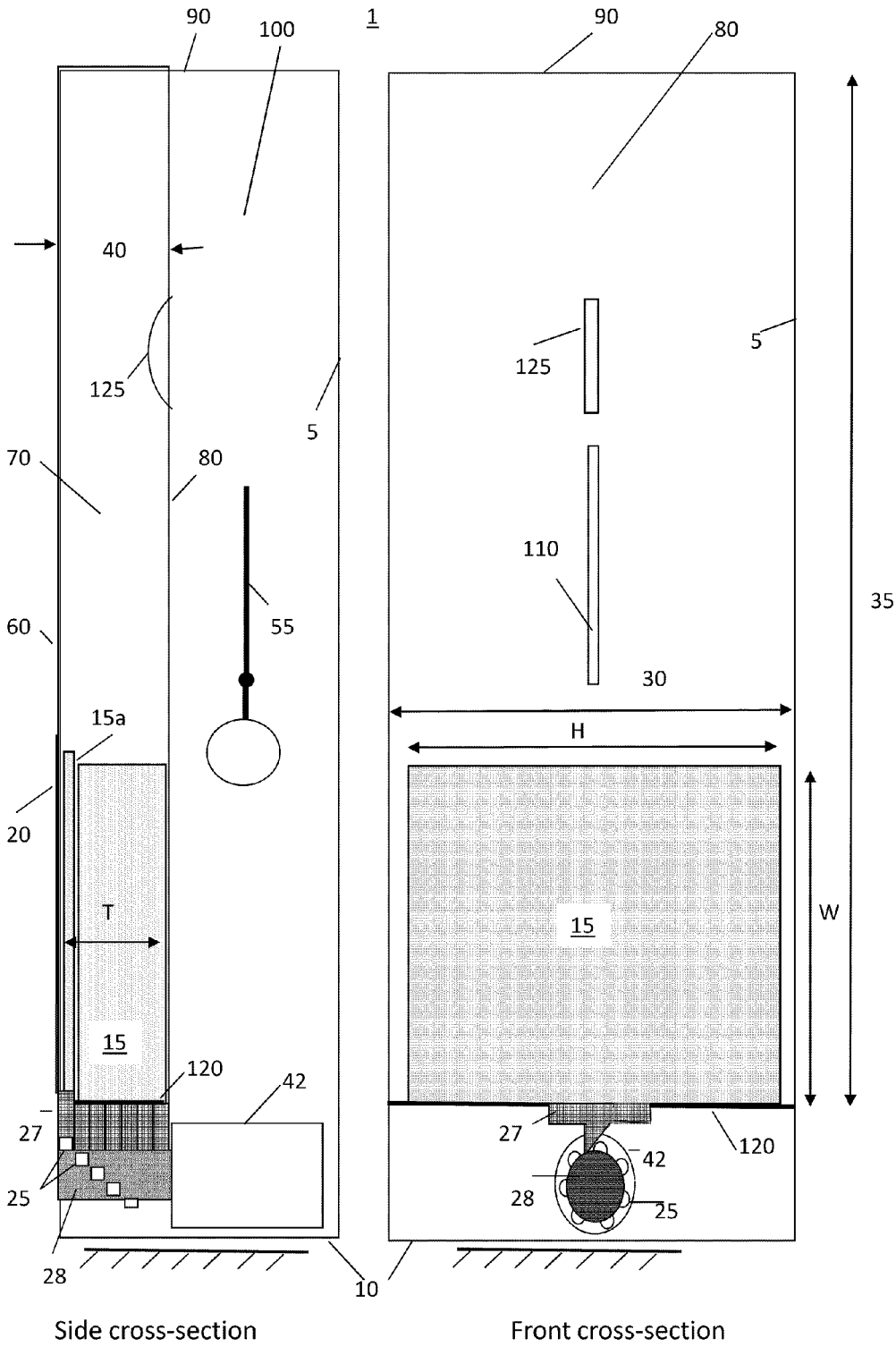
FIG. 1 shows front and side views of cross sections of the shuffling device, positioned vertically.

A card shuffling device 1 is shown in side and front cross section views in FIG. 1. The device 1 illustrated may be intended for, and dimensioned for use with, a single deck of cards, two decks of cards, or less than a deck of cards. It will be appreciated that a device capable of shuffling multiple decks of cards may also be capable of shuffling a single deck of cards or less than a standard deck of cards. The subsequent discussion will be in terms of a single deck of cards for clarity, however unless otherwise excluded, the operations are equally possible for a stack of cards comprising more or less than one standard deck.

Playing cards may be rectangular sheets of material, having a durable surface and the values and suits of a deck suitable for playing a game of cards displayed thereon. Often, the playing cards have a plastic surface, or are made wholly of plastic, although paper playing cards are known. Although the deck of cards may have more or less than 52 cards, for convenience in discussion a deck of cards is considered to be comprised of 52 cards. The dimensions of a single playing card may vary depending on the game of cards for which the deck is intended. For example, bridge and poker cards typically have different linear dimensions, however, a particular deck of cards may be used to play a game of cards for which the dimensions are not optimal.

Generally, playing cards are rectangles of flat material having dimensions less than about 3.5" by 2.5" (about 62 mm×88 mm) in the plane or face of the cards, so as to be held comfortably in the hand. Each card of the deck of cards is marked with a suit and value on one face thereof. For the purpose of discussion, the dimensions of the face are termed are the height H and the width W, respectively, so as to encompass decks of cards having other than the nominal dimensions. Each card of the deck of cards has a thickness, and the plurality of cards making up a deck of cards has a thickness T, the thickness being a dimension orthogonal to the height H and the width W of the cards. The periphery of the face is comprised of four edges, and the corners of the faces, where the edges meet, may be rounded.

The shuffling device may have a rectangular-parallelepiped-shaped interior compartment 70 having a first dimension 30 slightly greater than the card height H, a second dimension 35 at least twice the width W of the card, and a third dimension 40 greater than the thickness T of a deck of cards 15. The first dimension may be approximately 4 inches; and, the second dimension is not less than approximately 5 inches. In an alternative, the deck of cards 15 may be rotated by 90°.

A deck of cards may introduced into the interior of the device 1, for example through a lid 20 (shown closed), and the device 1 may be stood on an end 10 or base thereof. The second dimension of the interior compartment 70 may be oriented in a vertical position so that edges of the cards of the deck of cards 15 are parallel to a gravity vector g. The cards in the deck are acted on by a forcer so as to eject a contiguous group of cards 15*a* from the deck of cards 15 so as to be introduced into a space above the remainder of the deck of cards 15 in the second dimension. For this purpose, the thickness of the deck T may be considered to be divided into a plurality of volumes 15*a*, each volume 15*a* including a portion of the deck 15. The volumes 15*a* may not each contain the same number of cards. When the deck is in a static position of repose, and the device 1 is oriented as shown in FIG. 1, the cards are urged against a bottom surface 120 of the interior compartment 70 by the force of gravity.

A forcer or launching device, for example, a piston 27 and a kicker 25, which may be a cam, a piston, an electrical solenoid, a pneumatic cylinder, or the like, acts on a card volume 15*a*, at the lower surface thereof, so as to eject the card volume 15*a* upwards. Card volumes 15*a* may ejected upwards in a sequential manner, until substantially all of the cards in a deck of cards have been so ejected. The volumes sequentially ejected may be arranged a physically contiguous sequence, or may be ejected in another order. The ejection sequence may repeated rapidly for a plurality of such sequences. It may be imagined that the cards are in a somewhat chaotic state, with some cards being in contact with the bottom surface 120 or the piston 27, and some cards in varying dynamic positions, displaced with respect to the bottom surface, depending approximately on the time since the last ejection of the particular card or groups of cards. The pistons 27 may project above a surface 120 when actuated, which may be the surface that the cards rest upon when the device is not ejecting cards.

The ejection of a volume of cards 15*a* may be characterized as having a number of states: for example, repose, ejection, upward free flight, and free fall. In repose, the cards of the volume may be at rest with respect to the bottom surface 120, and in contact with either the bottom surface 120, or a piston 27 projecting through the bottom surface, or both of the structures. When the piston 27 is actuated, so as to eject the volume of cards 15*a*, the piston 27 moves rapidly in the second dimension of the interior compartment 70, and the volume of cards 15*a* being in contact with the piston 27 is accelerated in the second dimension until the piston 27 reaches the end of a travel distance. The piston 27 is constrained so the overall linear motion is limited, however, the volume of cards 15*a* may continue to move in the second dimension, with an initial velocity equal to the terminal velocity of the piston 27. The motion of the piston 27 is arrested by a stop or other mechanism, and the piston 27 may return to the repose position by action of the force of gravity. The return may be assisted by a spring, a double acting solenoid or pneumatic device, or other mechanism having a similar effect. The volume of cards 15*a*, however, continues in an upward direction, and may be said to be ejected from the remainder of the deck 15. The initial velocity of the volume of cards 15*a* when the piston 15*a* reaches the end of the stroke is sufficient that the minimum height reached by a lower card edge of the volume of cards 15*a* is greater than the dimension of a card in the direction of motion.

As the volume of ejected cards move in upward in free flight, the cards experience deceleration due to the force of gravity, and the velocity decreases such that, after a period of time, the vertical velocity of the cards is zero, at the maximum height of the cards above the surface 120. The cards then begin free fall, accelerated by the force of gravity, such that the motion of the cards is towards the repose surface 120, and the velocity of the cards increases with time, until the cards return to contact with the surface 120. The cards of the volume of cards 15*a* that was ejected now remains in repose and contact with the surface 120 until again ejected.

Due to the cross sectional dimensions of the base of the interior compartment 70 of the device 1, the individual cards have a limited ability to rotate about an axis perpendicular to the face thereof. The cards may rotate slightly so that the edges or portions of the face contacts a wall, and the motion of the card is affected by such interactions, by face-to-face contact with cards of the ejected volume, and with cards of previously or subsequently ejected volumes. Hence, while the cards may translate in the thickness direction, the cards are constrained to land on the bottom surface 120 or the piston 30 in the same rotational orientation as with which they were ejected. But, individual cards may be interchanged, or groups of cards urged to move in the thickness direction T. Movement in the thickness direction T may also occur for cards in the repose state, when acted on by other cards being ejected.

The value of the second dimension should be sufficient for the bottom edge of the ejected card to rise above the top edge of a card in repose. The value may permit the ejected card to reach an apogee of the trajectory without contacting the far end surface 90 of the interior compartment 70, or the value may result in some or all of the cards contacting the far end surface 90 during the ejection sequence.

In the example, providing that the second dimension 30 is less than the diagonal dimension of the face of a card of the deck of cards 15, the card may not be capable of rotating so as to change the rest or repose orientation of the height dimension H of the card with respect to the bottom surface. That is, the height and width dimensions of a card are not interchanged during the shuffling process, even if the card undergoes some rotational motion during the ejection process.

Where the deck of cards 15 is disposed in the alternative configuration, where the rest position of the deck of cards 15 has been rotated by 90°, an additional constraint on the second dimension 30 may be that the center of gravity of the card may need to be disposed such that it lies above the projection of the narrow dimension of the face of the card onto the bottom surface 120, in order to prevent rotation of the cards between the start and end of the process.

Figure 3:
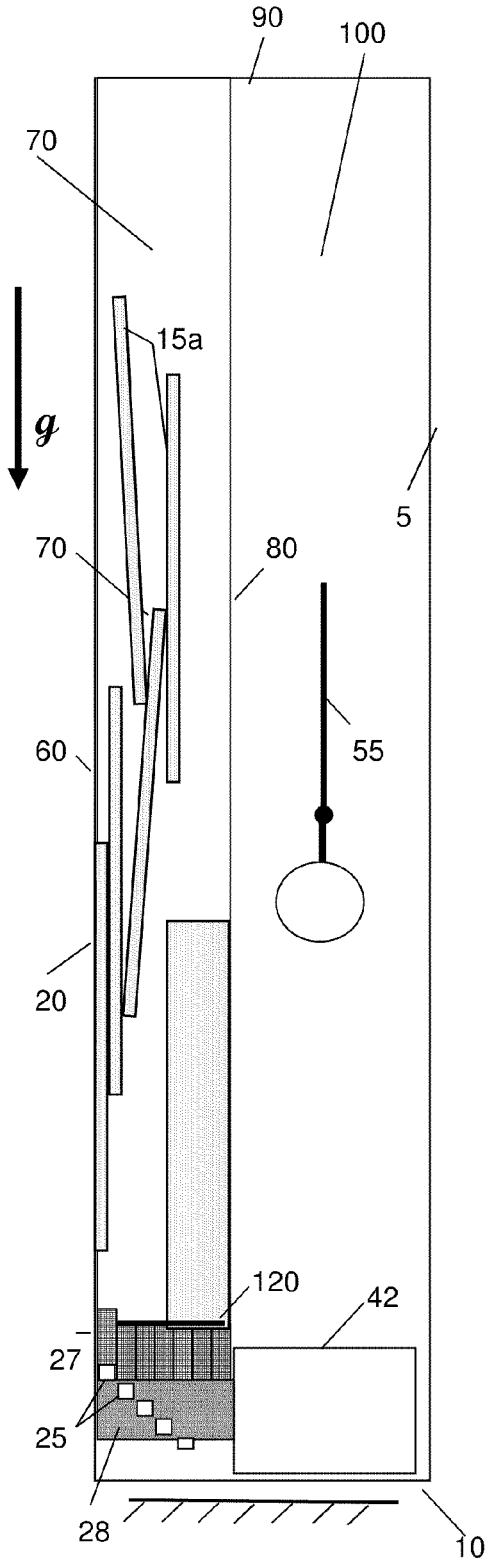
FIG. 3 is a side cross sectional view of the device of FIG. 1, positioned vertically, and with the cards being shuffled.

As may be seen in FIG. 3, when the sequence of ejections is being performed, various volumes 15*a* making up the deck of cards 15 may be in differing states with respect to the bottom surface 120.

The inventor has experimentally demonstrated this aspect of the operation of a shuffling device by using a cigarette carton as the rectangular parallelepiped compartment and a can of compressed air having a straw-type extension, such as is used to blow air into an electronics assembly for cleaning purposes. The end of the straw emitting the compressed air was directed at the base end of the carton through an aperture so that the pressurized air stream impinged on the bottom edge of cards and the nozzle rapidly moved back and forth in the thickness direction of the deck. The cards were observed to be ejected upwards in groups or individually and to reorder themselves in the somewhat chaotic environment where the cards are in various stages of flight. As the air pressure was either diminished or removed, the cards settled back into a deck of cards, resting on the base.

In the experiments, cards were placed in a deck so that the cards were ordered by suit and value, and the result of the operation above described was that the ordering of the cards in the deck of cards was observed to be effectively random after completion of the shuffling operation. A typical duration of the shuffling process was about 15 seconds.

In this manner, the ordering of cards in a deck of cards may be arranged in an effectively random manner. At the conclusion of the "shuffling" process, when the forcer sequence is terminated, the cards will be in the form of a randomized deck of cards. The shuffling device may then be rotated such that the second dimension is horizontal. This places the cards in the shuffled deck on top of each other, so that the lid or door of the shuffler can be opened, or a tray slid out and the cards removed.

The device 1, may further comprise a motor 42 turning a shaft 28, connecting to a cylinder 45, which may be termed a kicker, having projections 25 disposed at intervals along a length thereof, the projections 25 being disposed so that each of the projections 25 may come in contact with a piston 27 during a rotation of the cylinder 45. The projections 25 may have the shape of cams, or an equivalent projection may be present on a facing portion of the piston 27. The distribution of projections 25 may be such that adjacent pistons are actuated, or such that pistons 27 are actuated in some other sequence. Although the pistons 27 are shown as being contiguous across the thickness T of the deck of cards 15, the pistons 27 may have a spacing between them, and depend on the movement of cards in the T direction to move cards into position with respect to the pistons 27.

Figure 2:
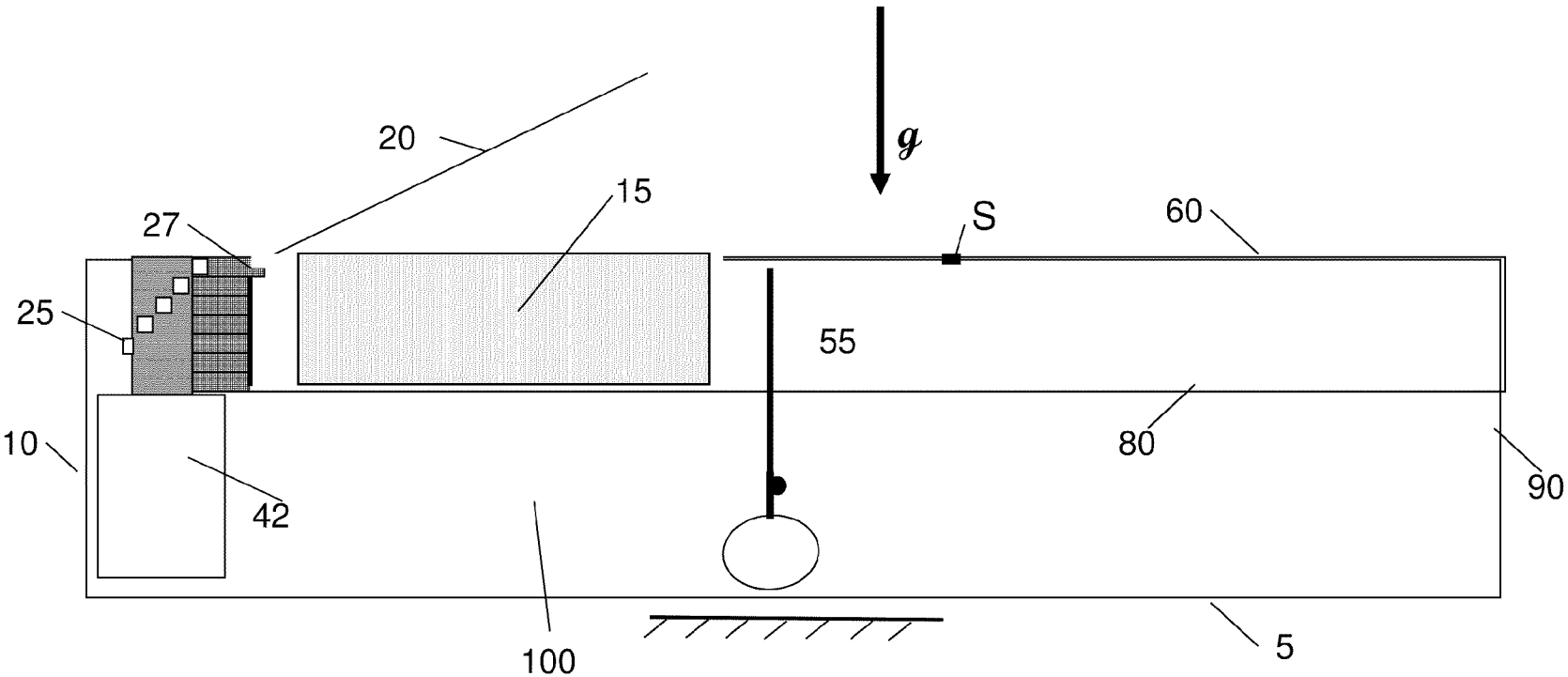
FIG. 2 is a side cross-sectional view of the device of FIG. 1, positioned horizontally, and with an access door partially opened.

FIG. 2 shows the device 1 disposed in a horizontal position, such that a surface 5 thereof is in contact with a horizontal support. Typically this support may be a table where the game of cards is being played. An interior compartment is formed by a first surface 80, extending in the second dimension, a second surface 60 also extending in the second dimension and disposed parallel to the first surface 80, separated by a distance 40, where the distance 40 is greater than the thickness T of the deck of cards 15 to be shuffled. A top end surface 90 of the device 1 is disposed opposite the base end 10, and at a distance such that a space of at least one card face dimension is provided between an inserted deck of cards 15 and the top end surface 90.

The interior surfaces 80, 60 of the compartment 70 are shown as being flat, however there may be projections 125 that extend towards the volume into which the cards are ejected, the projections disposed so as to convert some of the vertical motion into horizontal motion to further mix the cards. For convenience in discussion and description, the interior configuration of the compartment 70, while generally having the shape of a rectangular parallelepiped, should not, by being so described, be interpreted to exclude such mixing aids.

A compartment 100 may be provided so as to house batteries (not shown), a controller (not shown) which may be a microprocessor or other electronic or electromechanical device, and one or more motors, an air supply, or the like. The interior compartment 70 may be closed when the lid 20 is rotated or slid into a position to substantially fill an aperture through which the deck of cards 15 may be introduced into the interior compartment 70.

A compartment dividing bar 55 may rotatably project through an aperture 110 in the surface 80 so as to restrain cards of the deck 15 from inadvertently moving into the area to the right of the bar 55. The position of the bar may be changed by using a motor 50 or similar mechanism. Alternatively, as the bar is intended to be rotated with respect to the device 1 when the device 1 is moved between the vertical position of FIG. 1 and the horizontal position of FIG. 2, the motor may be replaced by an eccentric weight 50 on a shaft, and configured to maintain the bar 55 in a vertical position regardless of the operational orientation of the remainder of the device 1. Other mechanisms for positioning the divider 55 may be used.

The deck of cards 15 may be inserted into the device 1, with the device 1 in the horizontal position of FIG. 2, and the lid 20 is closed. The user rotates the device 1 to the vertical position shown in FIG. 1. In the vertical position, the deck of cards 15 slides so as to rest on the pistons 27 due to the force of gravity, and the bar 55 may have rotated to remain in a vertical position through slot 110, opening the remainder of the compartment 70 to the cards. In the front view, the compartment 70 is seen to have a first dimension 30, which is slightly greater than the height H of the cards.

The arrangement of the motor 45, the kicker 25 and the piston 27 is one of a variety of mechanical, electromechanical or pneumatic forcer mechanisms that may be used to transmit a substantially impulsive force to the edge of the cards now resting on the pistons 27. For example, the pistons may be electrically actuated by solenoids, or air pressure may be used. In an aspect, the piston may be an armature of the solenoid. A spring mechanism may be used to ensure adequate contact between a cam and the piston, as is known in a cam follower arrangement, or a spring may be provided to assist the force of gravity when the piston is returning to a condition of repose when operated by a forcer mechanism.

FIG. 1 shows a portion 15*a* of the deck 15 lifted with respect to the remainder of the deck 15 by one of the plurality of pistons 27, indicating the motion that may be imparted to portions of the deck 15 by a piston 27 when the motor 42 is rotating, and contact between a projection 25 and a piston 27 occurs. Alternatively the piston 27 may be coupled to, for example, a solenoid. As shown in FIG. 3, when the motor 42 is actuated to rotate the shaft 45, the kickers 25 may actuate the pistons 27 in rapid succession, so as to eject portions 15*a* of the deck 15 towards the top surface 90 of the apparatus 1. The sequence of ejections may become substantially asynchronous with the motions of the groups of ejected cards, so that the cards tend to mix together and migrate to other positions in the thickness direction T of the deck 15. In this manner, the cards of the deck are effectively randomized with respect to the sequence of cards in the deck 15 which obtained when the deck 15 was initially inserted into the compartment 70. The time duration of the mixing process may be based on a timer, or the user may have the option of turning the device on and off at will. In another aspect, a pressure switch may be disposed on the base surface 10 so that the motor 42 is activated when the apparatus is in the upright position and resting on the base surface 10 as shown in FIG. 3. Other sensing means such as an accelerometer (not shown) or the rotation of bar 55 may be similarly used to determine the orientation of the device 1 with respect to the direction of the gravitational vector. The shuffling operation may proceed for a fixed period of time, or the user may terminate the shuffling with an on-off switch, or by beginning to return the apparatus to the horizontal position shown in FIG. 2.

Near the end of the shuffling process, the speed of the motor may be reduced, and the cards may begin to settle back into a substantially resting position, in contact with the surface 110. To the extent that one or more cards have not yet moved into a position that generally conforms to the full deck 15, as shown in FIG. 1, the slower motion should cause the remaining cards to slide into position. A sensor (not shown, but positioned at S) may be used to confirm that the cards are back in the form of a deck of cards 15. This sensor may be optical or mechanical, or may be omitted.

Figure 4:
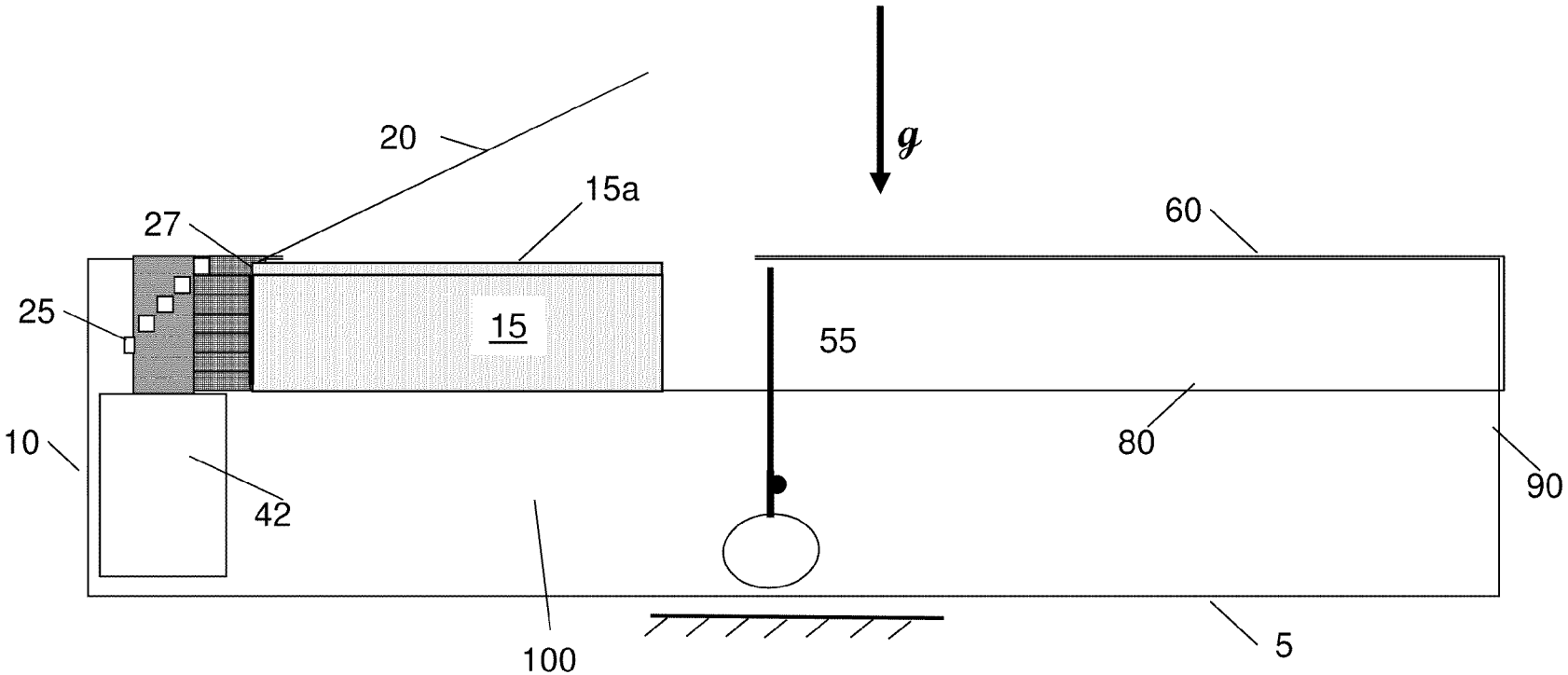
FIG. 4 shows the view of FIG. 3, with the device positioned horizontally after the completion of a shuffling operation.

FIG. 4 shows a near-end-state of the shuffling process. In this example, the bar 55 has been rotated into place by a motor 50, so as to enter the compartment 70 through the slot 110 in the surface 80, and the device 1 may still be in an orientation where the surface 5 is vertical. The device 1 may now be rotated to a horizontal position: that is, with surface 5 in a horizontal plane; and, the lid 20 may be opened to remove the deck of cards 15. Where an eccentric weight has been used in place of a motor, the bar 55 will rotate into the position shown in FIG. 4 as the surface 5 rotates into a horizontal position.

In yet another aspect, the lid 20 may be disposed that a hinge is positioned at the upper end of the aperture for insertion of the cards, and the lid 20 may extend further towards the top surface 90, so that when the lid 20 is rotated to an open position, the lid extension is rotated into the compartment 70 so as to perform the function of the bar 55.

In still another aspect, a surface of the apparatus 1 may be wholly or partially transparent, or have an aperture therein, so as to permit observation of the mixing action.

In another example, the automatic card shuffling device may be segmented at a height above the base such that the cards may be inserted or removed while the device 1 is in a vertical position (as in FIG. 1). In such a configuration, the interior compartment 70 may be formed by a lower portion and an upper portion: the lower portion being that extending from the base 10 to a location approximately that of the upper edge of a deck of cards inserted therein; that is, at or below the location of the compartment divider 55 in FIG. 1. The compartment divider itself may not be present. A relief or slot may be provided in the surface 60 so that the user may grip the cards in order to remove the cards from the lower compartment. The upper portion of the compartment may be attached to the lower portion of the compartment by a hinge, so that the upper portion of the compartment may be swung away for insertion and removal of the cards, and closed for the shuffling operation. The lid 20 and the compartment divider 55 may not be needed, since the cards may be inserted along the long dimension of the shuffler, and the device 1 may remain in a vertical position after completion of shuffling process.

In an alternative, the upper portion of the compartment 70 may be a separate structure and be joined to the lower portion of the compartment by a sliding connection so as to form a complete interior compartment 70, as in FIG. 2. The upper portion may be detached from the lower portion for the purpose of inserting or removing a deck of cards 15. The shuffling action may be initiated by a sensor determining that the compartments have been assembled, a switch, or other mechanism. The shuffling action may be dependent on the presence of cards in the compartment. The shuffling may be performed for a fixed period of time, or be controllable by the user.

Figure 5B:
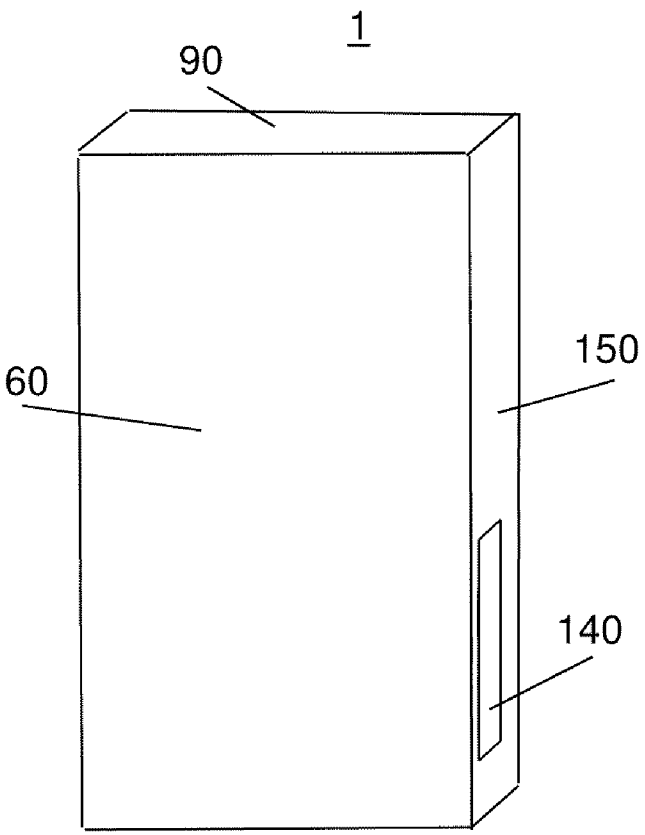
FIG. 5 is an exterior view of the device of FIG. 1, having (A) an access door, and (B) having a sliding drawer.
Figure 5A:
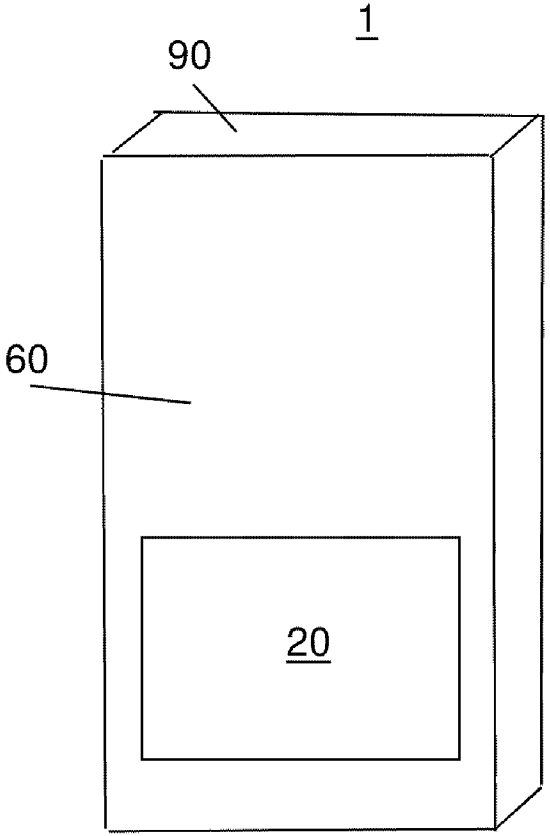

In another aspect, the device 1 of FIG. 1 may be configured so that the lid 20 is replaced by a slidable drawer 140 in a side 150 of the device 1. The lid configuration 20 and a drawer configuration are shown in exterior views in FIG. 5A-B, respectively.

Figure 6:
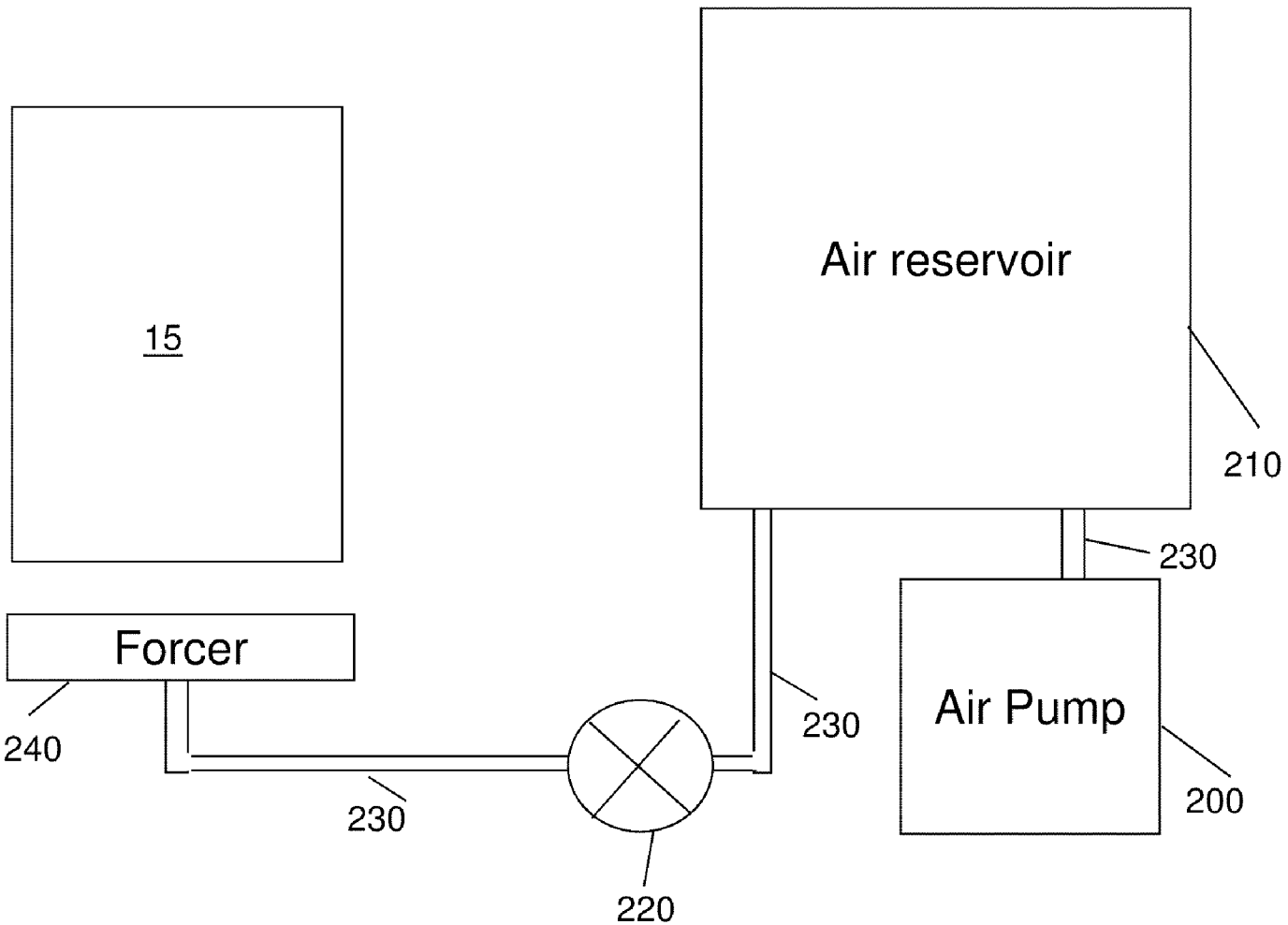
FIG. 6 is a simplified functional schematic of a pneumatic pressure source for a forcer.

In another example, shown in FIG. 6, the ejection mechanism may be pneumatic. A pneumatic pump 200 is used to charge a cylinder 210 to a pressure P, the pressure being above that of the ambient environment. The cylinder 210, may be a simple volume, or may have a piston and spring arrangement so that the filling of the cylinder involves the air pump 200 acting to fill a variable volume against the resistance of the spring. In this manner, the volume of the pressurized region increases at approximately a constant pressure. Similarly, the pressure is maintained substantially constant as the air in the cylinder 210 is discharged from the cylinder 210 so as to eject the cards 15*a* of the deck of cards. Near the end of the cycle, the piston in the cylinder 210 may reach an end of travel, so that the pressure decreases, having a similar effect as the slowing of the motor in the first example.

The cylinder 210 may be charged by the pump 200 for a fixed period of time, and then a valve 220 opened so that the air at nominal pressure P may flow from the air reservoir 210 to the forcer mechanism 240 to eject the cards. The air pump 200 may be shut off at this time, or continue to operate for some or all of the shuffling operation. After completion of the shuffling operation, the air pump 200 may be operated to charge the air reservoir 210 so as to be ready to perform another shuffling operation. Alternatively, the air pump 200 may charge the air reservoir 210 at the beginning of a shuffling operation.

In an aspect, the air pump 200 may supply air to the air reservoir 210 until a desired pressure is reached. This state may be sensed by a pressure sensor or a pressure actuated switch, and a valve 220 actuated to supply air to the forcer 240 so as to shuffle the cards. Alternatively, the air may be supplied through tube 220 so as to actuate one or more pistons 27.

Figure 7:
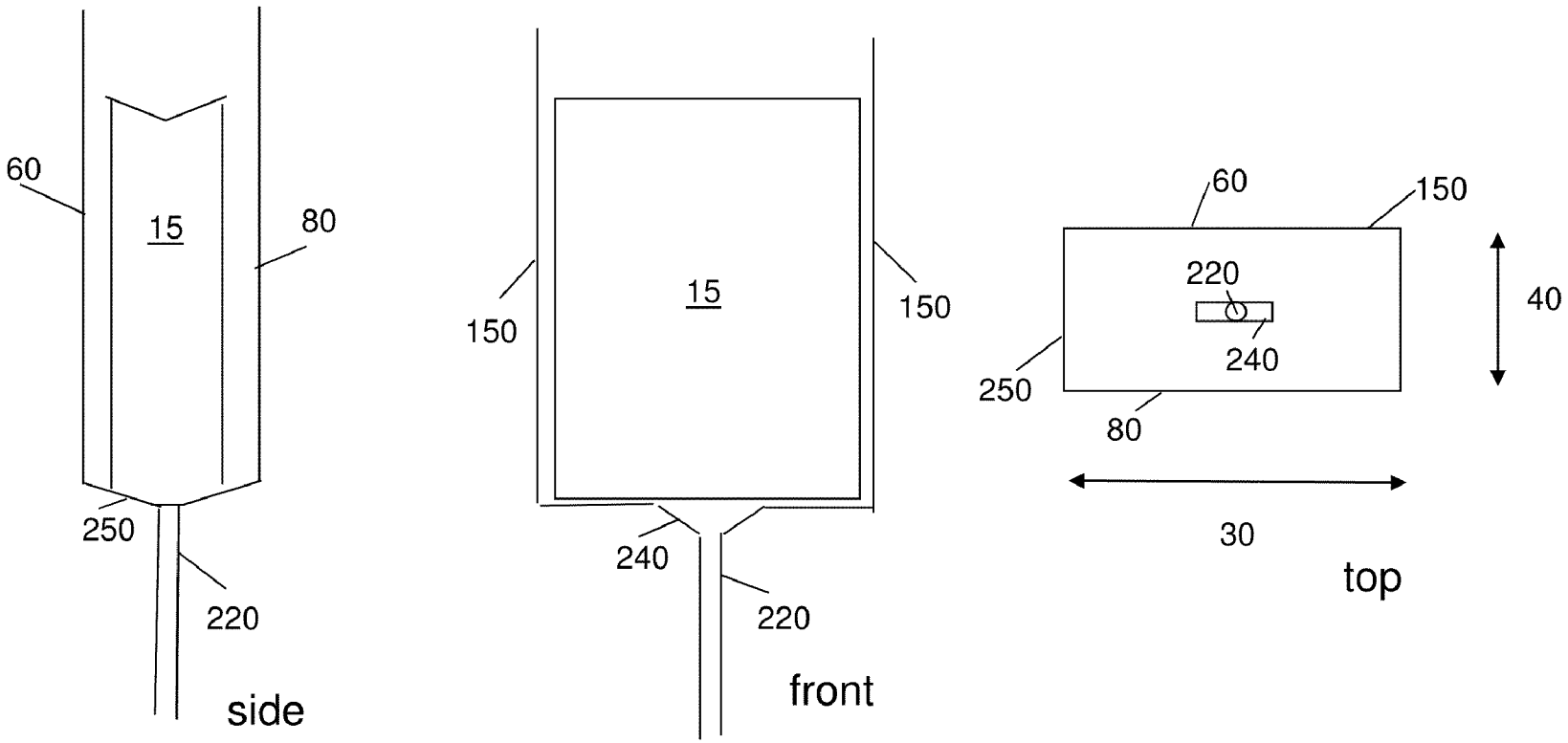
FIG. 7 shows partial cross section views of a pneumatic forcer.

FIG. 7A-C show side, front and top views, respectively, of a forcer using pneumatic actuation. The deck of is positioned as in the example of FIG. 1, however the bottom surface 250 of the compartment 70 is slightly sloped toward the center of the deck 15 in the deck thickness direction, rather than being a flat bottom 120 as in FIG. 1. The central portion of the deck of cards 15, shown in FIG. 7B is positioned above an orifice 240 having a larger linear dimension in the direction 30, than in the direction 40, so as to apply the air pressure P delivered through the tube 220 to side edges of a group of cards of the deck of cards. The dimensions of the aperture 240 are sized such that the force applied to the edges of the group of cards is sufficient to eject the group of cards into the void above to the top of the deck of cards. The air flow may be intermittently interrupted or pulsed, and the remainder of the cards in the deck of cards 15 may tend to move towards the center-of-the-deck region, so as to be positioned above the aperture 240 to be ejected by the next air pulse. The pulsing may be controlled by an actuated valve, a rotary valve or other method of interrupting the flow of the air.

In another aspect, the bottom surface 250 may be flat such as the surface 120 in FIG. 1, and a plurality of apertures 240 spaced apart in the deck thickness direction 40 so as to applied the ejection force at different times to groups of cards at different distances from the center of the compartment 70 in the thickness direction T of the deck of cards. A slight slope in the bottom surface 250 may be provided between the apertures 240 of the plurality of apertures, so as to encourage the migration of cards in the thickness direction.

Other methods of lifting the cards may also be used. For example, a continuous belt running between the base and the top of the interior compartment and having a bar or shelf projecting therefrom, where the length of the projection is about half of the thickness of a deck of cards may lift the cards. The structure may have an arched path of the belt neat the top portion so that the cards will be encouraged to move from the side where they were lifted to the other side of the compartment, in the thickness direction.

It will be understood that this recitation of elements and functionalities is intended to convey an appreciation for the types of elements and functionalities which may be present, however not all of the elements and functionalities may be found in a specific embodiment, and other elements or functionalities may be used multiple times.

Ancillary equipment such as a power supply, which may be batteries, a AC-DC converter (battery eliminator), an AC power supply, a controller, or the like, are not shown as they are well known to persons of ordinary skill in the art, as are the various types of motors, displays, solenoids, control interfaces and the like.

Although the present invention has been explained by way of the examples described above, it should be understood to the ordinary skilled person in the art that the invention is not limited to the examples, but rather that various changes or modifications thereof are possible without departing from the spirit of the invention. Accordingly, the scope of the invention shall be determined only by the appended claims and their equivalents.

What is claimed is:

1. A device for shuffling a deck of cards, the comprising:

a compartment, sized and dimensioned to receive a deck of cards, and having first and second dimensions larger than a first dimension of a face of a card of the deck of cards, and a thickness of the deck of cards, respectively; the deck of cards being received in the compartment;

a forcer;

wherein the forcer is actuated to apply an impulsive force to cards of the deck of cards when the face of the card of a deck of cards is oriented in a vertical direction, so as to eject cards of the deck of cards upwards into a third dimension of the compartment, the third dimension being greater than the twice a second dimension of the face of the card; and a projection from a wall of the compartment disposed so as to deflect cards ejected by the forcer.

2. The device of claim 1, wherein the first dimension is less than a diagonal dimension of the face of the card.

3. The device of claim 1, wherein at the ejected cards are returned to contact with the forcer by a force of gravity.

4. The device of claim 1, wherein the third dimension is aligned with a gravity vector when the forcer is applying the force.

5. The device of claim 1, wherein when an edge of the card of the group of cards is parallel to the gravity vector, and the force is not applied, the cards rest on a surface having a slope.

6. The device of claim 1, wherein when the device is in a state where shuffling is being performed, the compartment is substantially in the form of a rectangular parallelepiped.

7. The device of claim 1, wherein the impulsive force is applied for a time duration sufficient to effectively randomize the plurality of cards.

8. The device of claim 7, wherein the time duration of is controlled by a timer.

9. The device of claim 8, wherein the time duration is at least about 20 seconds.

10. The device of claim 7, wherein the time duration is controlled by a switch.

11. The device of claim 10, wherein the switch is actuated by gravity so as to be in an "on" position when an edge of the cards of the plurality of cards is substantially aligned with the gravity vector.

12. The device of claim 11 wherein the switch comprises an accelerometer or level sensor.

13. The device of claim 1, wherein the intermittent force is substantially impulsive.

14. The device of claim 13, wherein the force value of the intermittent force is decreased towards the end the time duration.

15. The device of claim 1, wherein the cards are received through an aperture closable by a door.

16. The device of claim 15, wherein the door is rotatable about a hinge, or slid able, to cover the aperture.

17. The device of claim 1, wherein the plurality of cards is a deck of cards for playing a game of cards.

18. A method of operating a device for shuffling cards, the method comprising:

providing a shuffling device having a container with interior dimensions sized and dimensioned to accept a deck of cards;

receiving the deck of cards in the container;

orienting the container so that a plane coincident with a face of a card, and an edge of the card, are parallel to a gravity vector and the received deck of cards rests at a bottom portion of the container;

providing a forcer adjacent to the deck of cards;

using the forcer to apply an impulsive force to cards of the deck of cards for a period of time so as to eject cards of the deck of cards in an upwards direction parallel to the face of the card, wherein the deck of cards rests at the bottom portion of the container subsequent to the period of time when the impulsive force has been applied.

* * * * *

UNITED STATES PATENT AND TRADEMARK OFFICE

CERTIFICATE OF CORRECTION

PATENT NO. : 8,109,514 B2
APPLICATION NO. : 12/828954
DATED : February 7, 2012
INVENTOR(S) : Hirohide Toyama It is certified that error appears in the above-identified patent and that said Letters Patent is hereby corrected as shown below:

In the Claims

In column 9, claim 1, line 54, after "a deck of cards," delete "the".

In column 10, claim 3, line 8, before "the ejected cards" delete "at".

In column 10, claim 8, line 22, after "wherein the time duration" delete "of".

In column 10, claim 14, line 37, after "towards the end" insert --of--.

Signed and Sealed this
Twenty-sixth Day of June, 2012

David J. Kappos

David J. Kappos
*Director of the United States Patent and Trademark Office*